United States Patent [19]

Raymond et al.

[11] Patent Number: 5,025,502

[45] Date of Patent: Jun. 25, 1991

[54] PUFF-OFF GLOVE

[76] Inventors: Douglas W. Raymond, 23 Martha Rd., Orinda, Calif. 94563; Thomas W. Smith, 60 Orinda Cir., Pittsburg, Calif. 94565

[21] Appl. No.: 408,805

[22] Filed: Sep. 18, 1989

[51] Int. Cl.[5] ..... A41D 19/00

[52] U.S. Cl. ..... 2/159; 2/161 A

[58] Field of Search ..... 2/2.1 R, 16, 18, 159-161 A, 2/161 R, 164, DIG. 1, DIG. 3, 159, 161 A; 223/211

[56] References Cited

U.S. PATENT DOCUMENTS

| | | | |
|---|---|---|---|
| 600,779 | 3/1898 | Frazier | 2/18 |
| 1,938,685 | 12/1933 | Breuls et al. | 223/111 |
| 1,996,377 | 4/1935 | Hinchen | 223/111 |
| 2,842,771 | 7/1958 | Foti | 2/2.1 R X |
| 3,649,966 | 3/1972 | Shields . | |
| 3,740,764 | 6/1973 | Elpstrom . | |
| 3,755,820 | 9/1973 | Petrusek | 2/18 |
| 3,872,515 | 3/1975 | Miner . | |
| 4,099,270 | 7/1978 | Jabour . | |
| 4,195,365 | 4/1980 | Eyman et al. | 2/161 A |
| 4,304,008 | 12/1981 | Joung . | |
| 4,345,335 | 8/1982 | Shih-Li | 2/161 A |
| 4,499,154 | 2/1985 | James . | |
| 4,503,565 | 3/1985 | Lipatt . | |

FOREIGN PATENT DOCUMENTS

| | | | |
|---|---|---|---|
| 104584 | 7/1938 | Australia | 2/18 |
| 3619180 | 12/1987 | Fed. Rep. of Germany | 2/DIG. 1 |
| 872596 | 7/1961 | United Kingdom | 2/2.1 R |

*Primary Examiner*—Allan N. Shoap
*Assistant Examiner*—Scott Cummings
*Attorney, Agent, or Firm*—Schapp and Hatch

[57] ABSTRACT

A glove is equipped with a mouthpiece containing an air passage. The mouthpiece allows the wearer to puff air into the space between the glove and the skin of the hand. The puffed up glove is much easier to doff and don than a conventional glove. A puff-off wetsuit glove for use in underwater activities is described in detail.

8 Claims, 4 Drawing Sheets

PUFF-OFF GLOVE

BACKGROUND OF THE INVENTION AND INTRODUCTION

Our invention is in the general field of gloves and protective clothing. In particular it is a new kind of glove combined with a mouthpiece which eases the doffing and donning of the glove. The preferred embodiment described here is a wetsuit glove used in underwater activity.

DESCRIPTION OF PRIOR ART

People who dive or work underwater usually wear protective gloves. The gloves reduce the rate at which body heat is lost through the hands in cold water; gloves also prevent skin abrasions and other minor injuries. Such gloves are normally called "wetsuit gloves," because they are made of the same materials that wetsuits are made of, and because they are most often worn along with a wetsuit.

Wetsuit gloves protect the hands and prevent chilling, but in so doing they reduce the wearer's dexterity. The material used to make the glove wall is thick in order to insulate: reduced flexibility and tactile sensation are unavoidable. Additionally, some gloves are built more like mittens than gloves, having fewer digit compartments than the wearer's hand has digits.

A person who wears wetsuit gloves therefore likes to put the gloves on in the later stages of suiting up, after most of the buckles, straps and laces of other underwater equipment have been fastened. After the wearer gets out of the water, the gloves are one of the first pieces of equipment removed.

In addition to their other characteristics, wet suit gloves fit the hand snugly, and are equipped with a very long wrist cuff. The long cuff and snug fit are designed to retard the circulation of cold water inside the glove, thus preventing chilling.

The snug fit and long wrist cuff also make it difficult to doff the gloves when they are wet, and to don the gloves again for additional dives. The skin of the wet hand does not slide easily against the wet inner surface of the glove. The elastic snugness of the glove material holds the glove material firmly against the skin, exacerbating the friction effect. To make matters worse, the water that has leaked into the glove during the underwater period tends to create regions of suction and air blockage between the hand and the snugly-fitting glove.

The suction regions make the glove difficult to doff while it is wet after a dive. The blocked air regions cause difficulty in donning the glove for a subsequent dive while it is still wet from a previous dive.

The materials, patterns and processes used in the construction of wetsuits and gloves are well understood in the protective glove industry, and will not be discussed in detail in this document except as they are relevant to the invention or to realizations of it.

OBJECTS AND ADVANTAGES

The present invention in its preferred embodiment introduces a wetsuit glove that is easy to doff and don while wet. Our new glove provides a mouthpiece through which the wearer may use his or her breath to puff the glove up during doffing and donning. The addition of the mouthpiece provides new and significant advantages over conventional wetsuit gloves. While puffed up, the glove wall is distended: It has less contact with the wearer's skin, so less frictional drag against it. Better yet, the distended glove has almost no tendency to form regions of suction or trapped air.

DRAWING FIGURES

Figure 1:
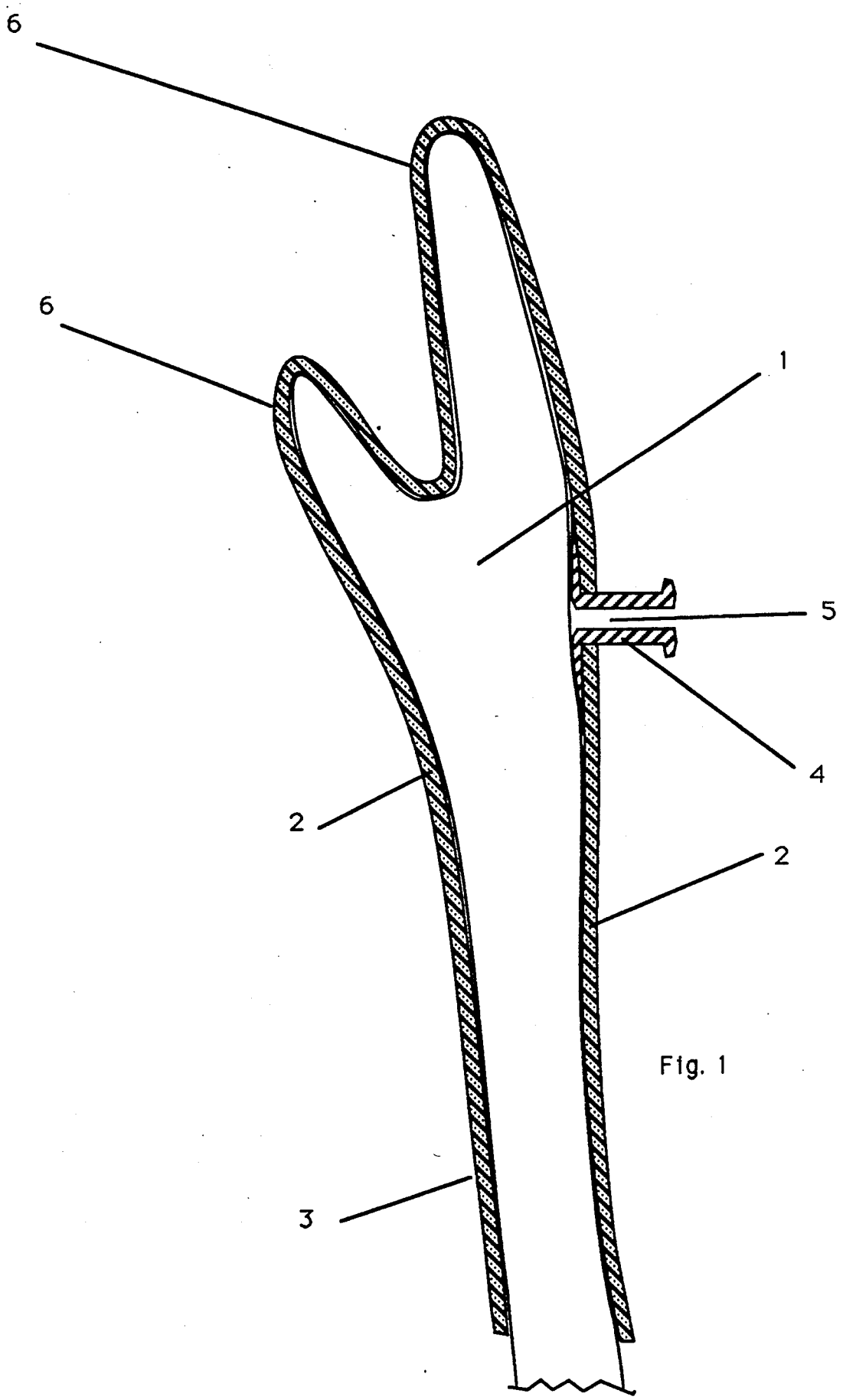
FIG. 1 shows in cross-section the glove in its normal donned condition, as it would appear during use.

These drawings are discussed in detail in narrative text that follows.

Reference Numerals used in the Figures:

1 Wearer's hand
2 Glove wall
3 Wrist cuff
4 Mouthpiece
5 Air passage
6 Digit compartments
7 Air space due to puffing up the glove
8 Arrows representing the air flowing into the glove
9 Flange portion of mouthpiece
10 Stem portion of mouthpiece
11 Mouth grip portion of mouthpiece
12 Outer surface of glove wall
13 Inner surface of glove wall
14 (number not used)
15 Glove for right hand
16 Arrows representing air escaping at the end of the wrist cuff
17 Glove for left hand

DESCRIPTION OF DRAWINGS AND PRINCIPLES OF OPERATION

In FIG. 1, the glove is depicted as fitting snugly on the wearer's hand 1, as it does during normal use. The mouthpiece 4 is mounted through a hole made for that purpose in the glove wall 2 at the back of the hand. The mouthpiece itself is made of flexible material so that the mouthpiece will not snag on obstructions. In addition to being flexible, the material of the mouthpiece must also be elastic, reasonably matching the elasticity of the glove wall 2. Mouthpieces made from hard material can cause discomfort at the knuckles. Hard mouthpieces could also lead to premature tearing of the glove wall under the repeated stresses of normal use.

The mouthpiece 4 contains an air passage 5. In the glove's normal condition of use, the inner end of the air passage 5 is closed by virtue of its contact with the wearer's skin. This effectively seals the air passage at its inner end, eliminating possible hazard for water leakage and consequent chilling. Mouthpieces for gloves for use in extremely cold water could additionally be equipped with plugs, sphincters, caps or other valves to positively close the air passage 5 against leakage and chilling, but such closures are not strictly necessary to the spirit of the present invention. Such closures would also be important on a glove used for protecting the wearer from hazardous or infective substances, and the like.

In wet-suit gloves, the wrist cuff 3 is made long so it can overlap the end of a wetsuit sleeve (not shown).

The sleeve is omitted from the drawing because wetsuit gloves are often worn without sleeved wetsuits, for example in tropical waters. The principal advantage of the present invention does not depend on the wearer also wearing a sleeved wetsuit. The length of the cuff 3 and the snugness of the glove, particularly in the digit compartments 6 make conventional gloves (i.e. gloves without mouthpieces) difficult to doff and don. As noted above, wetsuit gloves are particularly difficult to doff and don while they are wet.

Figure 2:
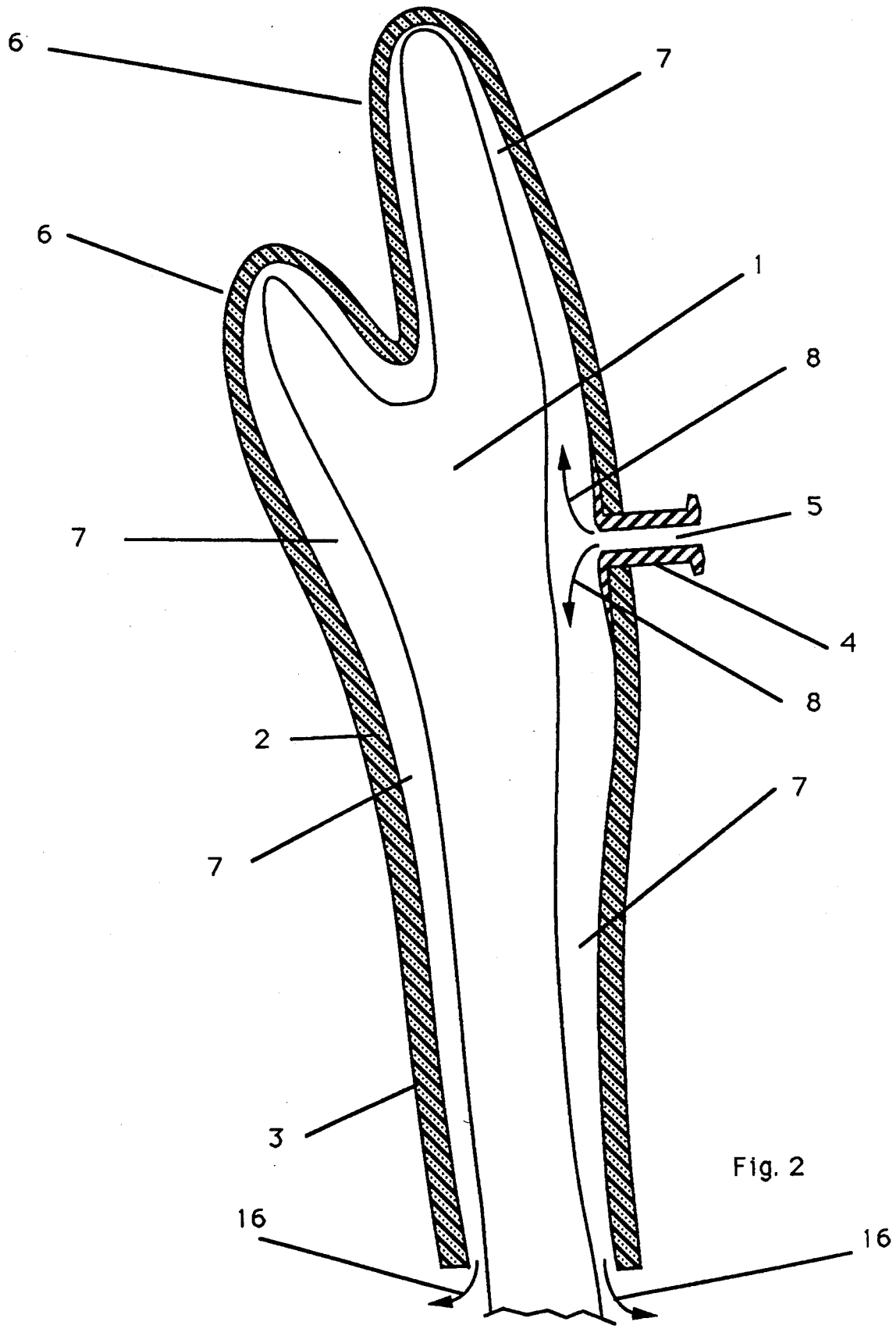
FIG. 2 shows in cross section the glove puffed up during donning or doffing.

In FIG. 2, note that there is an air space 7 between the hand 1 and the glove wall 2. The wearer creates this air space at will by using the mouthpiece 4 to puff in air from his or her mouth. The introduced air is shown as arrows 8 leading from the mouthpiece's air passage 5 into the glove air space 7.

The added breath pressure distends the glove wall 2, allowing the air space 7 to extend into the digit compartments 6 and along the inside of the wrist cuff 3. The air does not simply escape freely from the wrist opening because the long wet wrist cuff 3 has a tendency to retard the escape of the air. The escaping air is shown as arrows 16 leading out of the glove airspace 7 to the atmosphere. The air space 7 forces the glove wall 2 out of intimate contact with the hand 1 and allows the hand to move freely within the glove, permitting easy doffing and donning.

Figure 3:
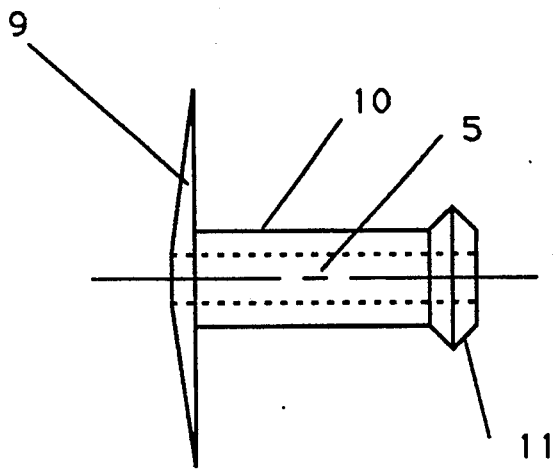
FIG. 3 shows a side elevational view of the added mouthpiece.
Figure 3A:
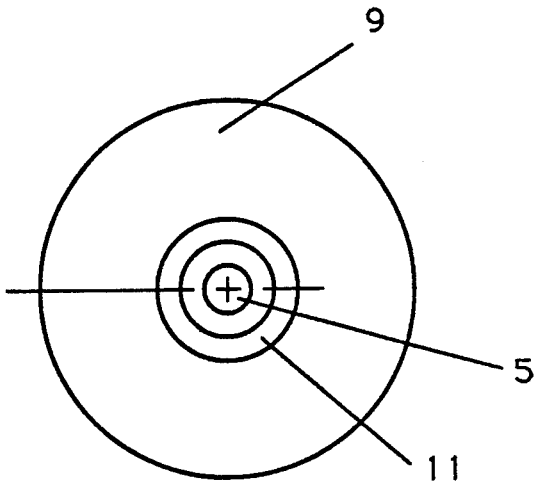
FIG. 3A shows a plan view of the added mouthpiece.

FIGS. 3 and 3A provide longitudinal and axial projections of the mouthpiece of the preferred embodiment. The mouthpiece is a solid of revolution. It consists of a flange portion 9, a stem portion 10 and a mouth grip portion 11. An internal air passage 5 runs the length of the mouthpiece. The flange portion 9 is tapered for two reasons: for wearer comfort, and to match the elasticity of the mouthpiece to the elasticity of the glove wall, preventing stress concentration at the mouthpiece edges.

Figure 4:
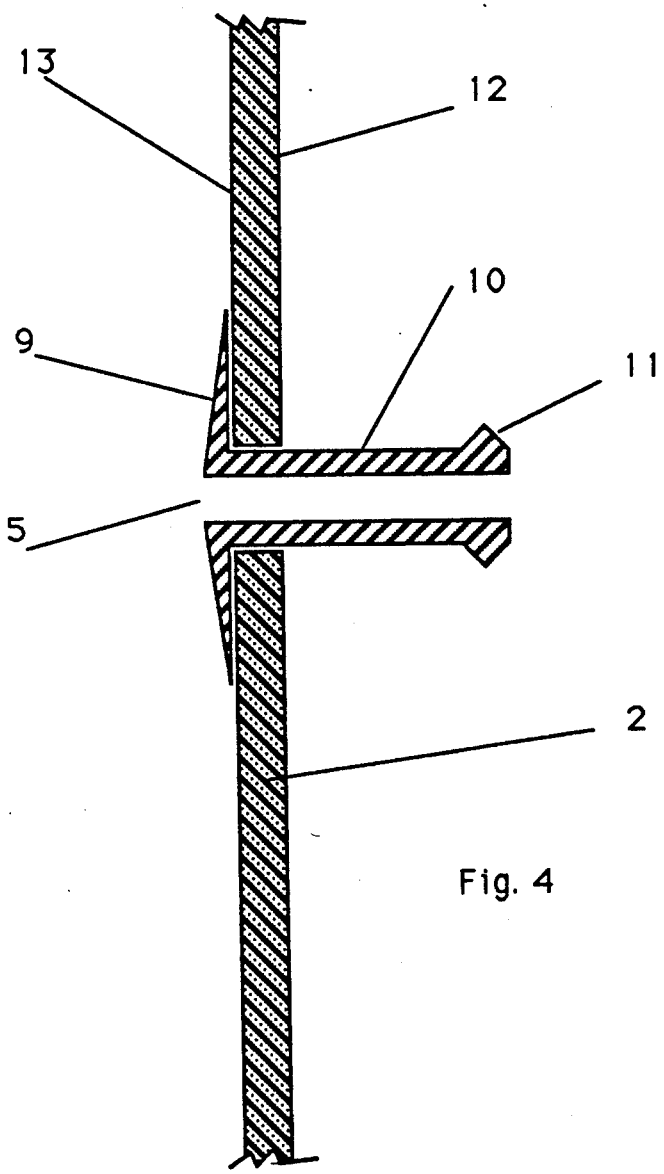
FIG. 4 shows in cross section the details of the mouthpiece attached to the glove material.

FIG. 4 shows in cross section the mouthpiece mounted to a section of glove wall material. The glove wall 2 has been pierced with a hole of diameter suitable for fitting the stem portion 10 of the mouthpiece, yet not too tight to pass the mouth grip portion 11 during assembly. The flange portion 9 is bonded with adhesive (not shown) to the inner surface 13 of the glove wall 2. Additional adhesive-bonding area is provided by the part of stem portion 10 within the hole in the glove wall 2. The stem portion 10 must be long enough to provide convenient mouth access to the mouth grip portion 11 when the glove is on the wearer's hand. On a glove intended for protection from hazardous or infective environments, extra length in the stem portion, together with a removable cap, is needed to prevent the mouth grip portion from becoming contaminated with the very substances the glove is intended to protect against.

While the method of attaching the mouthpiece in the preferred embodiment involes an adhesive, other common attachment methods such as stitching or vulcanizing could be substituted without departing from the spirit of the invention. Indeed the mouthpiece could even be molded as an integral feature of the glove wall without departing from the spirit of this invention.

Figure 5:
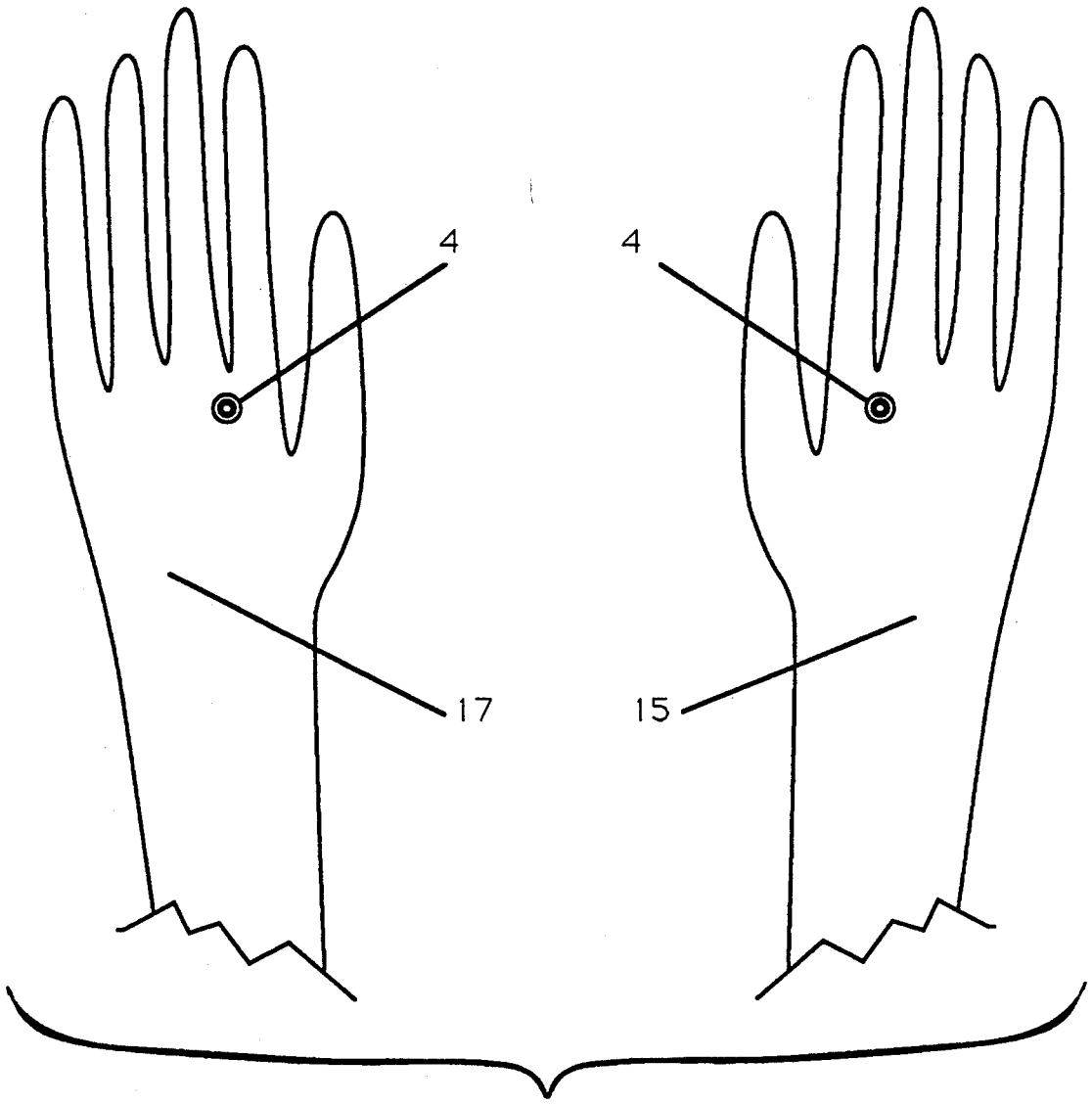
FIG. 5 shows a pair of gloves with mouthpieces attached.

FIG. 5 shows where mouthpieces 4 are mounted on the left-hand 17 and right-hand 15 gloves in the preferred embodiment. Dimensions are not shown, because specific dimensions are not crucial either to the understanding of the invention or to its realization. In the preferred embodiment as shown in FIG. 5, the mouthpiece is located slightly proximal to a point between the knuckle of the index and the knuckle of the middle finger.

Dimensions have been omitted deliberately from the figures, as the specific dimensions are not important to the understanding of the invention. Gloves come in many different sizes, and mouthpieces may be sized to match the gloves to which they are mounted. Details of glove piece patterns and assembly methods could influence the choice of location of the mouthpiece on the glove. The inventors respect the fact that the shape and location shown here are not the only possible shape and location for a mouthpiece that would embody the concept of this invention. Having seen these drawings, any designer skilled in the art of glovemaking gloves could easily come up with a workable design.

Using the Invention

Doffing the glove:

To puff up the glove, the wearer grasps the mouthpiece in his or her lips, and puffs air into the mouthpiece while lifting the mouthpiece away from the skin of the hand with a gentle tug of the lips. This action puffs up the glove as in FIG. 2. Continuing to puff air as needed into the mouthpiece 4, the wearer uses the other hand to grasp the inflated glove by the ends of its digit compartments 6, and pulls the gloved hand freely out of its glove.

Donning the glove:

The wearer inserts a hand as far as it will easily go into the unpuffed glove. The inserted hand now forms a partial seal inside the wrist cuff 3. The wearer then uses the mouthpiece 4 to puff up the glove, creating the air space 7. The wearer pulls the glove the rest of the way on by holding onto the wrist cuff 3. If the air escapes too rapidly from the wrist cuff 3 during this operation, the wearer can make it seal better temporarily by encircling it with thumb and middle finger of the free hand.

Additional Advantages

The principal intent of this invention is to make doffing and donning gloves easier. Experience with the preferred embodiment wetsuit version of the puff-off glove has shown additional unexpected advantages that we describe below.

When the wetsuit glove is uses in conjunction with a sleeved wetsuit, much of the air escaping from the wrist cuff flows into the sleeve of the wetsuit, puffing up the sleeve as well as the glove. The wearer can use this effect to settle the wetsuit more comfortably on his or her arms before entering the water.

When the wearer emerges from a cold water dive and puffs the wetsuit gloves, the warm breath in the glove provides a pleasant sensation.

SUMMARY

Users of wetsuit gloves will find the puff-off glove has the great advantages of easy doffing and donning, in addition to the lesser but still potent benefits of wetsuit sleeve adjustment and quick warmth after diving.

While our description of the preferred embodiment of the puff-off glove provides many specificities, the reader should not construe any of these as limitations on the scope of our invention, but only as examples or preferred embodiment of the invention. Those skilled in the art will envision many other possible variations within the scope of the invention. A number of variations have been suggested in the text, including variations in shape and dimesions, variations in methods of attachment of mouthpiece to glove, integrally molding a mouthpiece into the glove wall, plugs, caps and valves, and variations in location. The puff-off principle is easily applied to other types of gloves, including but not limited to surgical gloves, butcher's gloves, housecleaning gloves and the like. Many other variations can easily be conceived without departing from the scope of this invention. Accordingly, the reader is requested to determine the scope of the invention by the appended claims and their legal equivalents, and not by the examples which have been given.

We claim:

1. A protective glove, comprising a glove portion formed of flexible and conformable material and having an inner surface normally engaged with a hand wearing said glove, and inflating means on said glove portion providing a through passage extending from said inner surface to the outer surface of said glove portion for application of fluid under pressure through said inflating means to the interior of said glove between said inner surface of said glove portion and said hand for distending said glove portion away from said hand to facilitate doffing and donning of said glove.

2. A protective glove as described in claim 1, and wherein said inflating means comprises a fitting affixed to said glove portion and having a passage therethrough communicating the interior of said glove with the exterior.

3. A protective glove as described in claim 2, and wherein the end of said fitting exterior of said glove is formed and adapted for engagement by the lips of a user for application of exhaled air under pressure to the interior of said glove.

4. A protective glove as described in claim 1, and wherein said glove portion is made of an elastomeric material.

5. A protective glove as described in claim 4, and wherein said glove is further provided with an extended cuff portion of elastomeric material.

6. A protective glove as described in claim 1, and wherein said passage is positioned to open into said glove portion between the knuckles of the wearer.

7. A wetsuit glove of elastic material having an inner surface normally engaging the skin on the hand of the wearer, and a fitting of material of an elasticity similar to that of said glove and formed to provide an air passage into the interior of said glove, said fitting being adapted for engagement by the lips of said wearer for blowing exhaled air under pressure into the space between said inner surface of said glove and said skin of the hand of said wearer so as to distend said glove away from said skin of the hand of said wearer to facilitate doffing and donning.

8. A wetsuit glove as described in claim 7, and wherein said fitting is positioned on said glove to locate the inner end of said passage between the knuckles of the hand of said wearer.

* * * * *